US009629450B1

(12) United States Patent
Howard

(10) Patent No.: US 9,629,450 B1
(45) Date of Patent: Apr. 25, 2017

(54) RETRACTABLE TABLE

(71) Applicant: Grace Howard, St. Clair Shores, MI (US)

(72) Inventor: Grace Howard, St. Clair Shores, MI (US)

( * ) Notice: Subject to any disclaimer, the term of this patent is extended or adjusted under 35 U.S.C. 154(b) by 0 days.

(21) Appl. No.: 15/054,919

(22) Filed: Feb. 26, 2016

Related U.S. Application Data

(60) Provisional application No. 62/267,358, filed on Dec. 15, 2015.

(51) Int. Cl.

| | |
|---|---|
| ***A47B 1/00*** | (2006.01) |
| ***A47B 1/08*** | (2006.01) |
| ***A47B 1/06*** | (2006.01) |
| ***A47K 17/02*** | (2006.01) |

(52) U.S. Cl.
CPC ..... *A47B 1/08* (2013.01); *A47B 1/06* (2013.01); *A47K 17/02* (2013.01)

(58) Field of Classification Search
CPC .... A47B 1/08; A47B 3/00; A47B 3/06; A47B 3/12; A47B 5/00; A47B 5/02; A47B 5/06; A47B 23/04; A47B 37/00
USPC ..... 108/42, 48
See application file for complete search history.

(56) References Cited

U.S. PATENT DOCUMENTS

| | | | | | |
|---|---|---|---|---|---|
| 3,357,336 | A * | 12/1967 | Vendig | G03D 17/00 | 108/48 |
| 4,501,457 | A * | 2/1985 | Pond | A47B 5/06 | 108/44 |
| 4,803,930 | A * | 2/1989 | Crocoli | A47B 5/06 | 108/117 |
| 5,170,719 | A * | 12/1992 | Pestone | A47B 5/04 | 108/134 |
| 6,408,465 | B1 * | 6/2002 | Fleming | A47B 23/04 | 5/620 |
| 2009/0249982 | A1 * | 10/2009 | Palethorpe | A47B 5/00 | 108/44 |
| 2015/0366409 | A1 * | 12/2015 | Cohen | A47B 47/0075 | 4/611 |

* cited by examiner

*Primary Examiner* — Daniel Rohrhoff
(74) *Attorney, Agent, or Firm* — Young Basile Hanlon & MacFarlane, P.C.; Denise M. Glassmeyer

(57) ABSTRACT

A retractable table apparatus that includes a table portion, the table portion with a flat planar member having a first end and a second end that defines a tabletop; at least one support member secured to the tabletop proximate the second end of the flat planar member; and a base portion having a lateral body with an outwardly oriented surface and a lateral slot defined in the outwardly oriented surface and projecting into the lateral body, the slot dimensioned to receive the second end of the tabletop. The second end of the tabletop is insertable in the slot to place the apparatus in a first condition where a user has access to the tabletop, and wherein when the second end of the tabletop is removed from the slot, the apparatus is placed in a second storage condition.

8 Claims, 7 Drawing Sheets

RETRACTABLE TABLE

BACKGROUND

The disclosure herein relates generally to furniture and fixtures, more particularly the present disclosure pertains to portable devices that can be used in rooms with limited area such as for use in a restroom, college dormitory, closet or the like, with particular application in bathrooms.

Restrooms are one of the most commonly used, yet smallest, rooms in a building. Restrooms are multi-use rooms. In some situations, a user may desire to take care of personal needs, such as using a toilet. In other situations, the user may desire to take care of other personal needs, such as cleaning and grooming. Further, restrooms may be used by multiple users, for example, to share a romantic bath, or to help each other with their hair and make-up styling.

A problem arises however, as restrooms often have a limited amount of available surfaces to organize and store items utilized by the user(s). Creation of additional surfaces for use by the user(s) may be difficult given the size constraints of areas such as are found in restrooms. This is further complicated by the presence of immovable fixtures such as toilets, bidets and the like. Accordingly, an apparatus for providing additional working surface area and organizational opportunities in a restroom or rooms with limited surface area is desired.

SUMMARY

As disclosed, the apparatus includes a table portion that includes a tabletop with a first end and a second end. A support member is secured to the tabletop proximate its first end. The second end is opposed to the first end and is configured to be secured to a location proximate to a structural wall member.

The apparatus may also include a base member that has a rear surface that can be mounted to the structural wall member and has a slot formed in a front surface of the base portion. The slot is dimensioned to releasably receive the second end of the tabletop. The second end of the tabletop is inserted in the slot to place the apparatus in a first condition where a user has access to the tabletop and the tabletop extends perpendicularly outward from the base portion and is oriented essentially parallel to the floor or other support surface. When employed in a restroom application, the table top can extend over an associated toilet or bidet to contain the restroom fixture underneath it. When the second end of the tabletop is removed from the slot to place the apparatus in a second condition, the user has access to the devices underneath such as the toilet or bidet. The base portion can have a second slot longitudinally oriented relative to the first slot. The second end of the table top can be slideably received in the second slot and can be positioned parallel to the associated support structure during storage.

Another aspect of the disclosed embodiment is an apparatus for use in a restroom with a toilet. The apparatus comprises a tabletop with a length, a width, a first end, and a second end. A support member with a length is secured to the tabletop proximate the first end. The length and width of the tabletop are dimensioned such that the tabletop extends to cover the toilet when the tabletop is positioned over the toilet. The length of the support member is dimensioned to be greater than a height of the toilet. The second end of the tabletop is free of support members.

Another aspect of the disclosed embodiment is an apparatus for use in a restroom with a toilet. The apparatus comprises a base portion with a slot formed in a front surface of the base portion. The base portion has a back surface having a pair of extruded portions positioned on either side of a recessed portion. The base portion has the form of an L-shape extending in a width direction at least as far as a width of the toilet.

BRIEF DESCRIPTION OF THE DRAWINGS

The description herein makes reference to the accompanying drawings wherein like reference numerals refer to like parts throughout the several views, and wherein.

DETAILED DESCRIPTION

With reference to FIGS. 1-8, an apparatus for organizing a small space such as a restroom is shown. The apparatus as depicted includes a base portion 10 and a table portion 13. The base portion 10 mounts to a support structure such as a wall. When used in a restroom, the base portion 13 can mount to the wall at a region proximate to a toilet in a relationship overlying the top of the tank portion of toilet T. In certain embodiments, the base portion 13 will be mounted to the associated support structure at a location that provides a spaced distance between the top of toilet T and the lowest portion of base portion 13. The spaced distance will be that sufficient to provide access to any flush mechanisms position on the top of toilet T (not show) or permit access to the interior of the toilet tank where desired or required.

Figure 1:
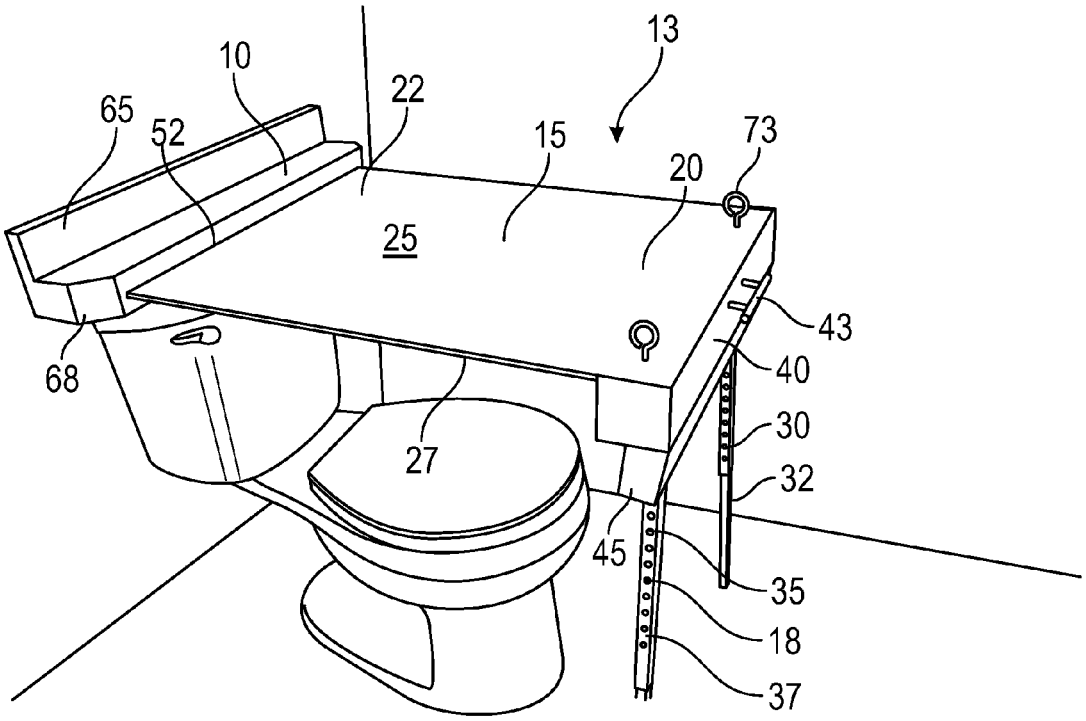
FIG. 1 is a perspective view of an embodiment of an embodiment of the retractable table apparatus as disclosed herein in a first configuration.
Figure 2:
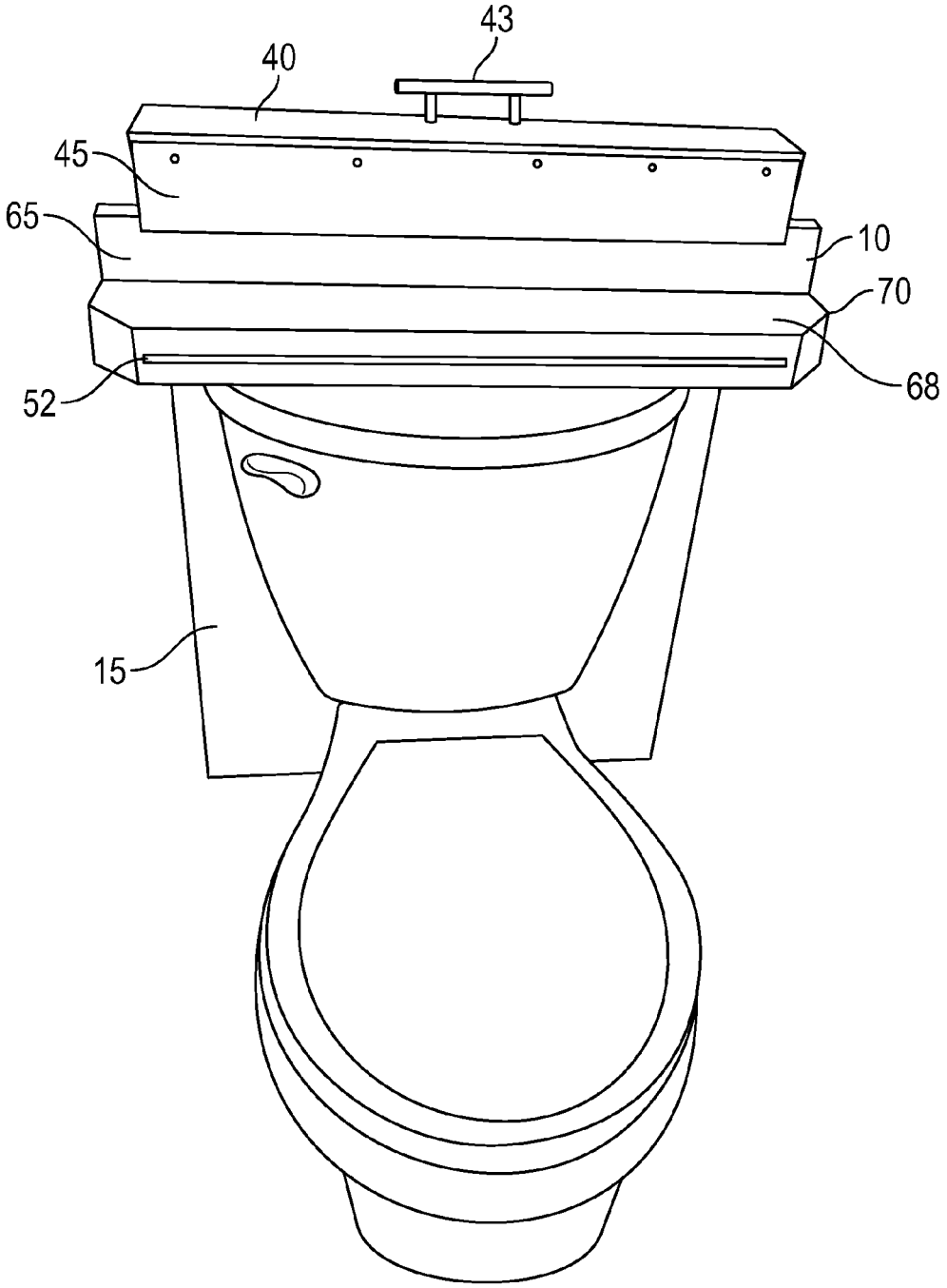
FIG. 2 is a perspective view of the apparatus of FIG. 1 in a second configuration.
Figure 3:
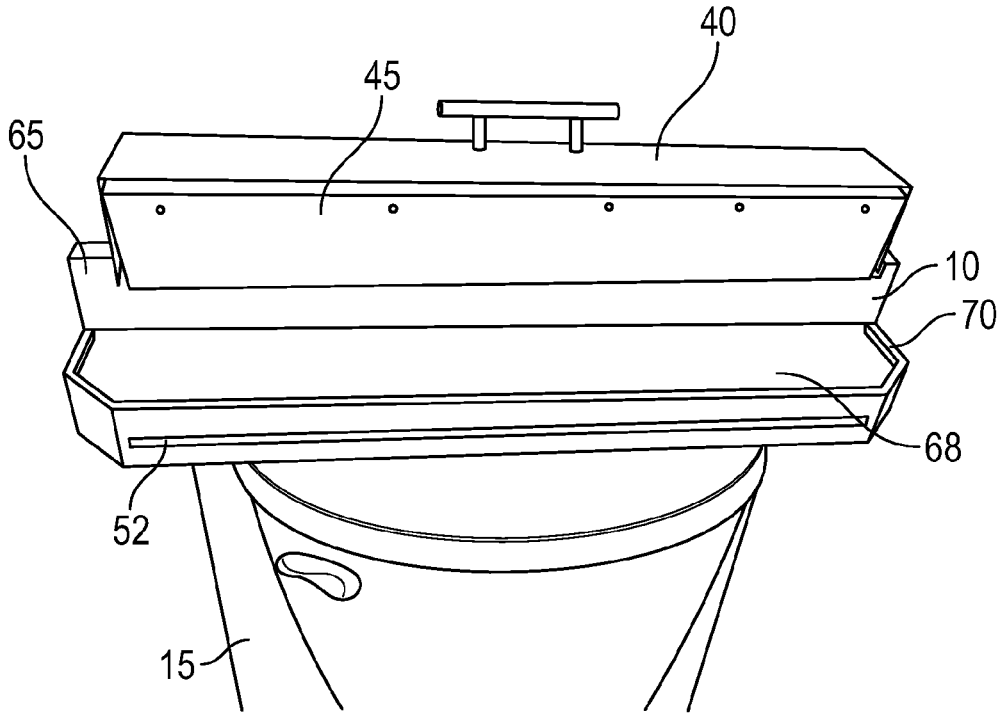
FIG. 3 is a close-up perspective view showing of the apparatus of FIG. 1 in the second or stored configuration.

The table portion 13 includes a tabletop 15 having a first end 20 and an opposed second end 22 and at least one support member 18 that is connected to the table top at a location proximate to the second end 22. In a first configuration, as shown in FIG. 1, the table portion 13 can extend over the associated toilet T, with the base portion 10 and one more support members 18 providing support to the tabletop 15. In a second configuration, as shown in FIGS. 2 and 3, the base portion 10 may be used to store the table portion 13 so that the toilet T may be accessed for general use.

The tabletop 15 is dimensioned with a length L and width W such that the tabletop 15 is generally longer and wider than the toilet. In addition to the first end 20 and the second end 22, the tabletop 15 includes a top surface 25 and bottom surface 27. The first end 20 and second end 22 are located opposite each other in the length direction of the tabletop 15. The tabletop 15 may be constructed of wood, plastic, metal, composites, or any other material sufficient to provide a rigid form capable of supporting a plurality of personal products such as restroom products, containers of liquid, books, laptops, candles, and other similar items. The tabletop 15 may be made from a combination of materials, and may include additional reinforcing structures such as extruded ribs or internal reinforcing rods as desired or required.

The support member(s) 18 are secured to the tabletop 15 at the second end 22. In certain embodiments, attachment of the support member(s) 18 can include suitable devices such as at least one associated hinge device or the like that permits the support member(s) to move from a storage position to a use position. The use position for support member(s) 18 is generally perpendicular to the plane of the tabletop 15. When tabletop 15 is in the use position, the support member(s) 18 extend from the tabletop 15 to the floor. In the first condition as shown in FIG. 1, the support member(s) 18 are generally perpendicular to a plane of an extending direction of the tabletop 15. The storage position for support member(s) 18 is one where the respective member(s) are oriented in a position relatively parallel to the plan of the surface of the tabletop 15. In the embodiment depicted, the hinge device is mounted to the bottom surface 27 of the tabletop 15 proximate to the outer edges of the tabletop and allows the respective support member(s) 18 to be pivoted from the use position to a position where the respective member abuts the tabletop 15 generally parallel to the tabletop 15 and extends in the width direction W when the apparatus 10 is in the second configuration shown in FIG. 4.

The support member(s) 18 can be adjustable in length where desired or required. Length adjustment can be accomplished by telescopic twisting of first and second sub members relative to one another. It can also be accomplished by peg and pin mechanisms as depicted in the drawing figures.

As shown in FIG. 1, the support member 18 may include a top portion 30 and a bottom portion 32. The top portion 30 and bottom portion 32 of the support member 18 engage with, and slide axially relative to, each other. The top portion 30 may have a series of holes 35 and the bottom portion 32 may have a spring-loaded peg 37. The peg 37 is received in one of the holes 35. The peg 37 and hole 35 combinations each secure the top portion 30 relative to the bottom portion 32, giving the support member 18 a certain desired length. To adjust the length of the support member 18, a user depresses the peg 37 so that it is no longer received by the hole 35. The user then applies force in the axial direction to the top portion 30 and/or bottom portion 32 of the support member 18 to slide the top portion 30 relative to the bottom portion 32 until the peg 37 engages with another one of the holes 35, thereby lengthening or shortening the support member 18.

As an alternative to the hole 35 and peg 37 combination, the adjustable length of the support member 18 may be provided through the use of various tightening collars and clamps that secure the top portion 30 and the bottom portion 32 relative to each other through the use of friction and compression. These alternate securing means and methods allow a more precise adjustment of the length of the support members 18. It is contemplated that the adjustment mechanisms permit the user to level the tabletop 15 in the first condition based on the specific use situation. Because the height of the second end 22 of the tabletop 15 from a floor of the associated room such as the restroom is determined, at least in part, by the mounting position of the base portion 10. Adjustable support member(s) 18 as outlined in the disclosure permit use of the device as disclosed at various mounting height conditions. Assuming the floor of the restroom is level, providing the same height from the floor to the first end 20 and the second end 22 of the tabletop 15 helps to ensure the tabletop 15 is level.

The tabletop 15 may also include a suitable enclosure 40 positioned proximate to the second end 22. In the embodiment depicted, the enclosure 40 can project outward from the lower face 27 of the tabletop 15 and can house the hinge device(s) that secure the support member(s) 18 to the tabletop 15. It is contemplated that the enclosure 40 can house the support member(s) 18 when they are in the pivoted to the storage position parallel to the tabletop 15. Where necessary, the storage member(s) 18 can include suitable retraction mechanisms such as those described previously. In the use position, enclosure 40 which at least partially surrounds the first end 20 of the tabletop 15 and extends in a downward direction. At least one handle 43 may be secured to the enclosure 40 to help manipulate the table portion 13 when a user desires to transition the apparatus between the first condition and the second condition. In the embodiment depicted, the handle is centrally located at the midpoint of the enclosure 40. The handle 43 may be located in other locations as desired or required. It is also contemplated that the handle may be affixed directly to the tabletop 15 in some embodiments or configurations.

The enclosure can also conclude a suitable shroud 45 that is moveably connected to the enclosure 40. In the embodiment depicted, the shroud 45 may be secured to the enclosure 40 with a hinge. The hinge is positioned an configured to allow the shroud 45 to be pivoted between an retracted position to cover the retracted support member(s) 18 and a non-retracted position in which the shroud 45 pivots outward from the enclosure 40 to permit the support members 18 to extend away from the tabletop 15 in the first or use position, as shown in FIG. 1. The shroud 45 generally covers the support member 18 from the sight of the user in the second condition, as shown in FIG. 2.

The enclosure 40, handle 43, and shroud 45 may be made of metal, plastic, or other suitable materials, including various combinations thereof. The hinge connecting the shroud 45 and enclosure 45 may, for example, be provided as a multi-piece design formed of metal, as shown in the FIG. 3; it may be provided and formed from a flexible material such as rubber, leather, or other suitable material; or it may be provided as a living hinge formed of the same material as the enclosure 40 and shroud 45.

The first end 22 of the tabletop 15 may be free of any attached support members or other similar structures. Instead of having attached support members, the first end 22 may be held in position in the first condition by resting on another object. In certain embodiments, the tabletop 15 can rest directly on a suitable support such as the top of the toilet tank. In certain embodiments, the first end 22 of the tabletop 15, may be received in a suitable location in the base portion 10.

In the embodiment as disclosed herein, the base portion 10 includes a projecting member 50 having a front facing surface. The projecting member 50 can have a suitable width. IN certain embodiments, the width of the projecting member will be sufficient to extend to a value equal or greater than the any mechanism such as a toilet T that it is to overlay. In certain embodiments, the width of the projecting member 50 will be between 5% and 25% greater than the width W of tabletop 15. The projecting member 50 will also have a suitable depth which will be discussed subsequently.

As depicted in the various drawing figures, a slot 52 is defined in the front facing surface of the projecting member 50 and extends inward from the front facing surface to a defined distance therein. The slot 52 is dimensioned to receive the first end 22 of the tabletop 15 when the apparatus is in the first condition. The slot 52 can have a height that is greater than or equal to a thickness of the tabletop 15 and a width that is greater than or equal to the width W of the tabletop 15. The depth of the slot 50 will be that sufficient to receive the first end 22 of the tabletop 15 and maintain it therein.

The projecting member 50 can have a suitable depth to house slot 52. Additionally, where desired or required, the slot 52 can have a suitable depth to define a shelf that has an upwardly oriented surface sufficient to receive various bottles, devices ornamentation or the like.

The base portion 10 also has a back member 55 that is connected to the projecting member 50 and extends upward form the device receiving surface. As depicted, the back member 55 has a first face and an opposed second face. In the embodiment depicted, the first face of the back member 55 is contiguously connected with the upper ace of the projection and defined a right angle therewith.

Figure 5:
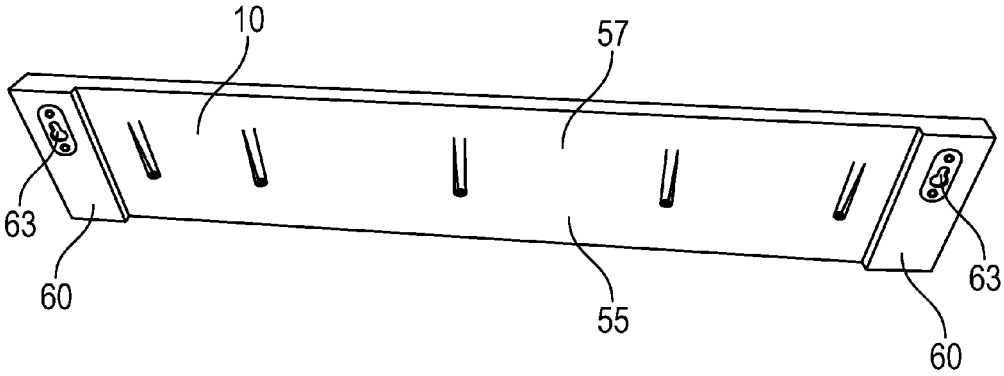
FIG. 5 is a perspective view of a rear of the base portion of the apparatus of FIG. 1.
Figure 6:
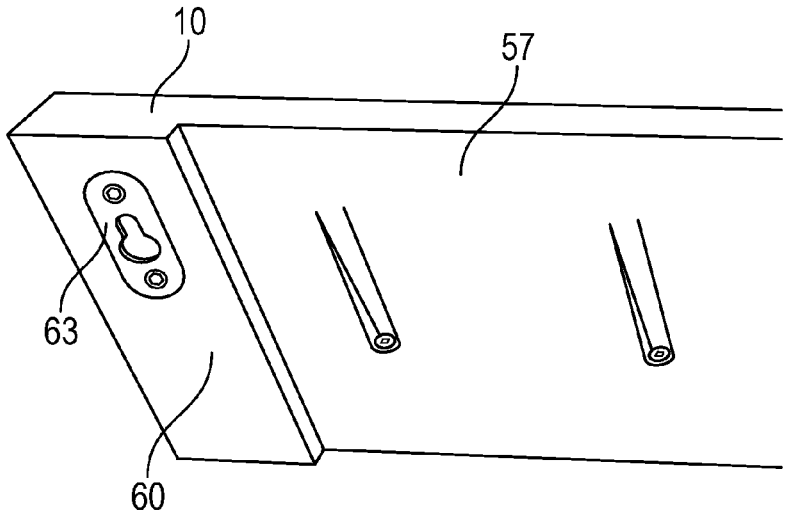
FIG. 6 is a close-up perspective view of a portion of the rear of the base portion of the apparatus of FIG. 5.

The opposed second face of back member 55 of the base portion 10 includes a recessed portion 57 and a pair of projecting portions 60, as shown in FIGS. 5 and 6. The projecting portions 60 straddle the recessed portion 57 on either side in a width direction of the base portion 10. The recessed portion 57 and pair of projecting portions 60 are offset from each other by an amount that is greater than or equal to the thickness of the tabletop 15.

When the base portion 10 is mounted on a support surface such as an associated wall, the projecting portions 60 abut the wall and create a gap between the wall and the recessed portion 57. In the second condition, the tabletop 15 may be aligned vertically and received in the gap created between the recessed portion 57 and the associated wall, thereby defining a slot into which the second end 22 can be inserted and the tabletop can be slidingly received there through. Alternately, were desired or required, the back member 55 can have a suitable slot defined therein. The slot in the back member 55 can provide a convenient storage location for the table portion 13 as shown in FIG. 2.

The second surface of back member 55 of the base portion 10 can include attachment points 63 or suitable attachment mechanisms for securing the base portion 10 to the wall or other suitable support surface. The attachment points 63 can be configured to permit the base portion 10 to be removably secured to the wall, allowing access to the toilet. Non limiting examples of suitable attachment devices include toggle bolts hook and the like. Such attachment device can be ones that extend into the associated wall. Alternately, the attachment mechanism can be one that includes suitable adhesives such as cement and the like.

In certain embodiments, it is desired that the base member 10 be removably mountable to the wall. Removal of the base member can be desirable to facilitate access to the toilet for servicing and the like. For example, when a top of the toilet tank needs to be removed to service the toilet, the base portion 10 may be removed from its mounting on the associated wall without tools or the adjustment of hardware. To facilitate removal, the attachment points 63 may include a wide portion positioned below a narrow portion. To install the base portion 10, a head of a fastener secured to the wall, such as the head of a drywall screw partially screwed into the wall, may be received in the wide portion. The base portion 10 may then be moved downward, and a shaft of the drywall screw received within the narrow portion of the attachment point 63. To remove the base portion 10 from the wall, the base portion 10 is lifted to slide the shaft of the drywall screw to the wide portion, where the head of the drywall screw may be removed.

The base portion 10 may have an L-shape with a vertical portion 65 defining the back member 55 and a horizontal portion 68 defining the projecting member 50. The L-shape of the base portion 10 may extend in a width direction, with the width of the base portion 10 being greater than that of the toilet. Depending on the restroom in which the device as disclosed is used, the width of the base portion 10 may extend substantially beyond the toilet, limited by the constraints of the restroom and any fixtures therein.

A lip 70 may be included along an outer perimeter of the horizontal portion 68, as shown in FIGS. 2 and 3. The lip 70 extends away from the horizontal portion 68 in an upward direction. The lip 70 helps prevent any items placed on the horizontal portion 68 from falling off by creating a barrier along the outside perimeter.

The back member 55 can have any suitable height. In certain embodiments, the height of the projecting member can be equal to or greater than the extension of the projecting member 55. In the use position, when mounted to a suitable support structure such as a wall, in certain embodiments, the back member 55 can have a height sufficient to accommodate various bottles and the like. This can be between 4 and 12 inches in certain embodiments.

Figure 4:
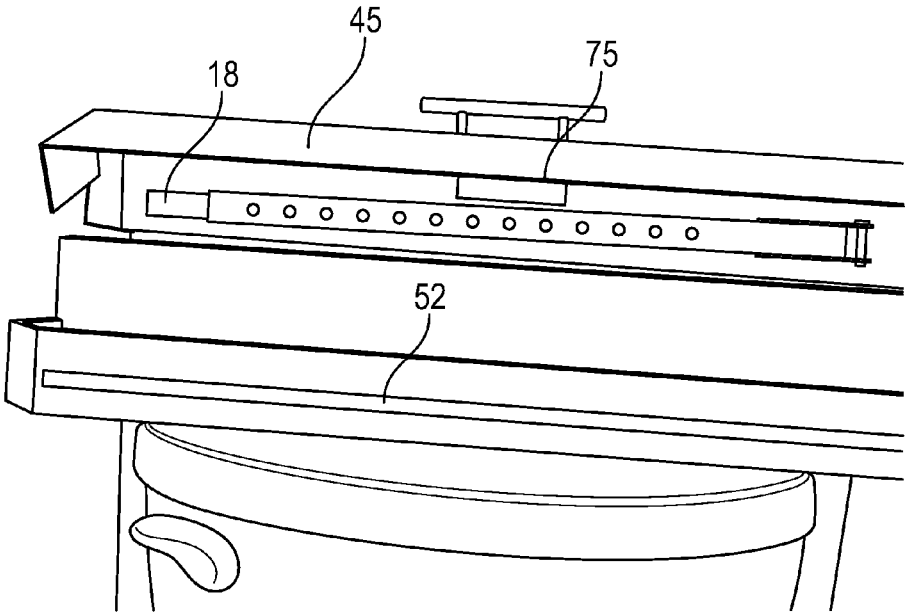
FIG. 4 is a close-up perspective view showing an embodiment of the apparatus of FIG. 1 in a stored orientation.

When the tabletop 15 is positioned in slot 57 in the second or storage condition, the enclosure 40 can contact and overlay the uppermost edge of back member 55 as depicted in FIGS. 3 and 4, providing an aesthetically pleasing accent to the projection member 50 and any associated bottles or devices placed on the projection member 50. Where desired or required, the enclosure can be equipped with suitable illumination devices 75 such as LED lights or the like that can be placed at suitable locations in the enclosure to provide accent illumination and/or a suitable night light for use in the associated room. The illumination device 75 can be configured as a suitable lighting strip, a series of individual lights in spaced relationship in or on the enclosure, can be a pair of light units proximate to the respective sides of the enclosure. The illumination device(s) 75 can be located on the exterior of the enclosure, the interior of the enclosure or any combination thereof. In certain embodiments, the illumination device(s) will be positioned in a suitable manner to provide a continuous down lit region for the projection member 50. In the embodiment depicted in FIG. 4, the illumination device 75 is centrally located on the shroud 45. Other locations on the shroud 45 or the other regions of the enclosure 40 can be employed if desired.

It is contemplated that the illumination device(s) 75 can be powered by a suitable power source (not shown) for example either by a battery or batteries associated with or connected to the table portion 13 such as the enclosure 40 or with a suitable power source external to the enclosure 40 or the table portion 13. The illumination device 75 and associated table portion 13 can also include suitable control devices. Non-limiting examples of suitable illumination control devices include user actuated on/off switched, light level sensors, motion sensors and combinations of the foregoing.

To provide a more pleasant environment in the restroom, the table portion 13 may include lights 75, as shown in FIG. 4. The lights 75, such as battery-powered LED units, may be secured to the inside of the enclosure 40 behind the shroud 45. The lights 75 may provide a pleasant lighting effect to the base portion 10 when the tabletop 15 is stored in the gap created by the recessed portion 57, or to other structures or objects proximate a hanging location chosen by the user when the table portion 13 is hung by the attachment portions 73 as will be describe subsequently. The bottom surface 27 of the tabletop 15 may include artwork or other decoration, such as a painting or a print, spotlighted by the lights 75. The lights 75 could also serve as a nightlight for the restroom.

As an alternative to storing the table portion 13 in the slot 57 defined in or by the back member 55, the table portion 13 may be stored at a suitable location distinct from the base member 10. In one embodiment, it is contemplated that the tabletop member 15 can be positioned such that the table top 15 is mounted to an associated wall by any suitable means. For example, the top surface 25 of the tabletop 15 may include one or more attachment mechanisms 73, such as protruding hooks or eyelets secured to proximate to the first end 20 of the tabletop 15, as shown in FIG. 1. The attachment mechanisms 73 can be hooks, eyelets or other devices configured to engage suitable mating attachment structures in position on the wall structure 73 such as additional hooks or eyelets on the wall of the associated room such as the restroom (not shown), enabling the user to hang the table portion 13 vertically in the desired location.

Figure 9:
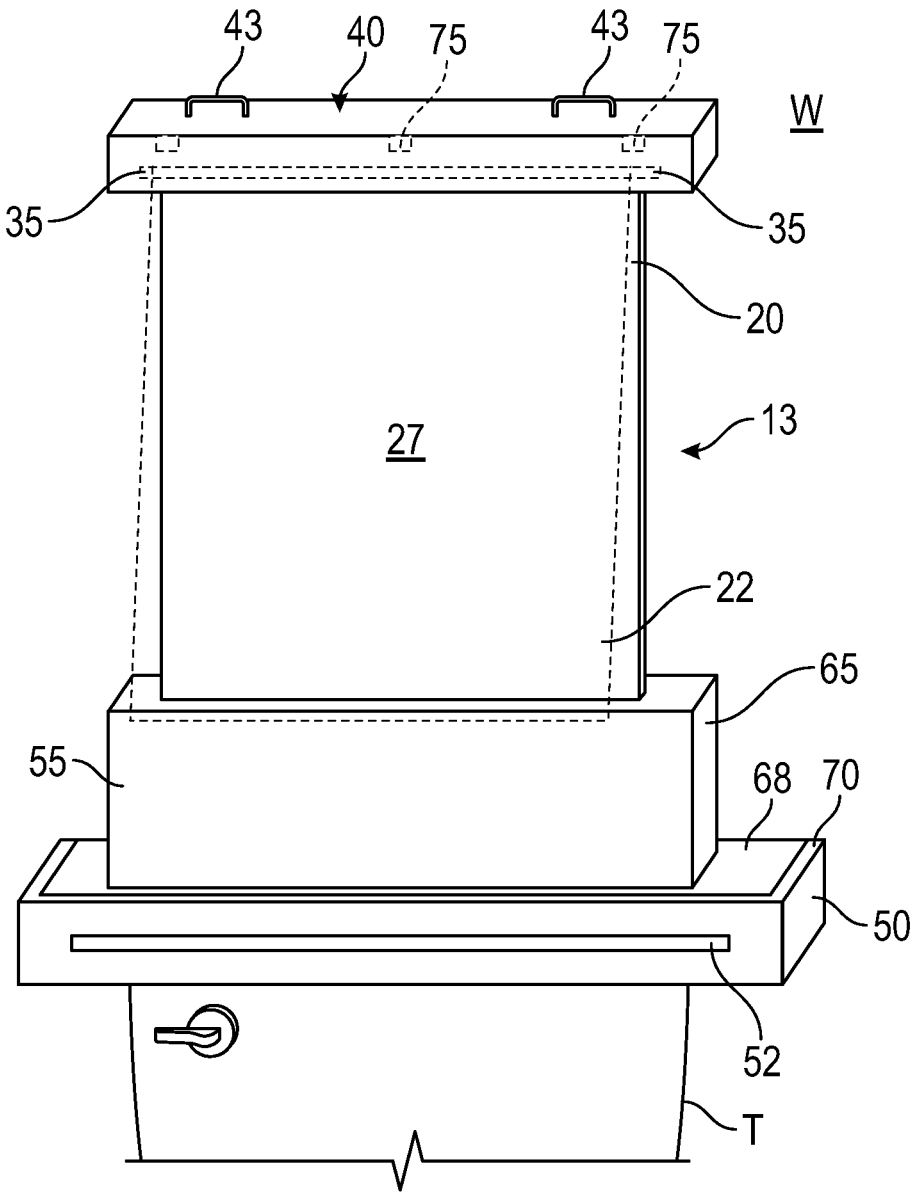
FIG. 9 is a perspective view of an embodiment of the device as disclosed herein in which the table portion is oriented in display mode relative to the base portion.

While it is contemplated that the table portion 13 can be hung at any location desired, in certain embodiments, the table portion 13 can be hung at a location proximate to and above the base portion 15, one non-limiting example of such orientation is depicted in FIG. 9. In such orientations, the table portion 13 is mounted to the support member such as the wall W at a location that vertically overlies the base portion 15. In the embodiment depicted in FIG. 9, the edge of tabletop 15 that is proximate to the first region 20 is engaged in slot 57, with the bottom face 27 of table top exposed to view. The bottom face 27 of table top 15 can be configured to receive a suitable artistic work as selected by the user or can be preconfigured as a decorative surface as desired or required that would be displayed when the device is positioned in the display position. It is also contemplated that the bottom surface 27 of table top 15 can be configured to include a suitable message board such as white board, cork board or the like (not shown) on which the user can affix reminders, inspirational messages etc. In certain configurations, the reminders messages, etc., can remain in place during movement between the first and second conditions. It is also contemplated that where the user does not wish private messages to be readily viewable by guests or other third parties, the table portion can be moved from the vertical overlying position as depicted in FIG. 9 to the position where the enclosure 40 is on contact with the base portion 10 as depicted in FIG. 2.

The embodiment and configuration depicted in FIG. 9 also provides one non-limiting example of a lighting pattern in which three lighting devices 75 are positioned in the enclosure 40 equidistant across its elongate axis. The lighting devices 75 cast light beam patterns that L that illuminate that bottom surface 27 and can provide auxiliary or night lighting as desired or required.

Figure 7:
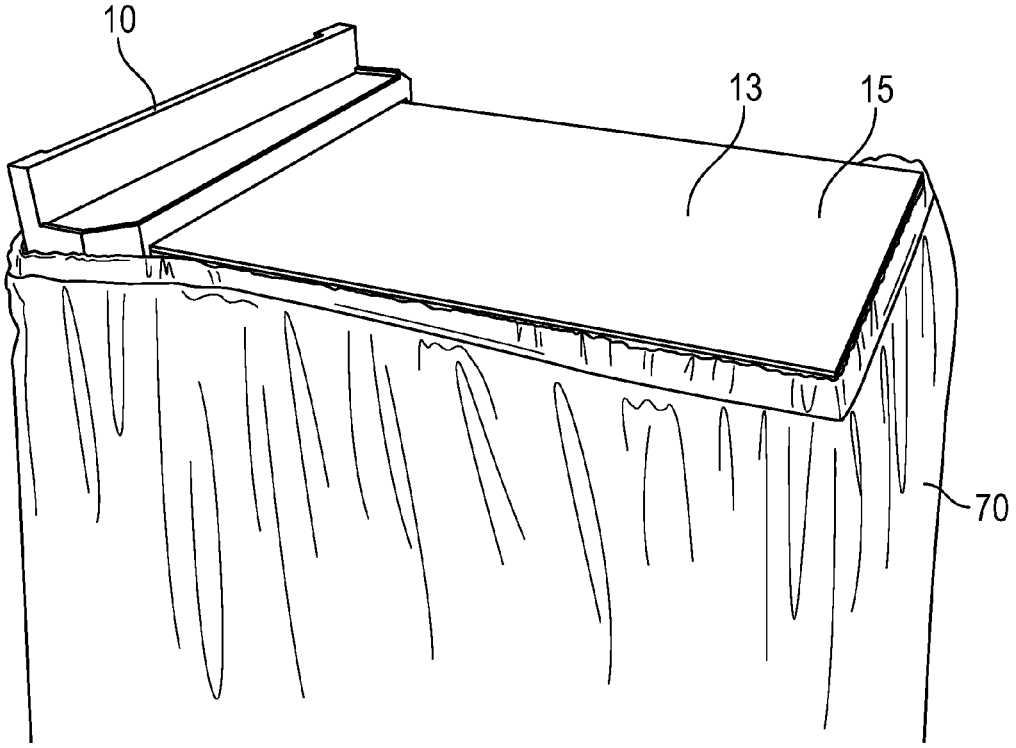
FIG. 7 is a perspective view showing the retractable table apparatus of claim 1 cin the use position configured with a skirt.

A skirt 70 may be secured to the base portion 10 and the table portion 13 when the apparatus is in the first condition, as shown in FIG. 7. The skirt 80 secures to the base portion 10 at one end, extends around and secures to a perimeter of the table portion 13, until to it abuts an opposite end of the base portion 10. The skirt 80 allows the toilet to be hidden from view, thereby helping to change the general atmosphere of the restroom.

Figure 8:
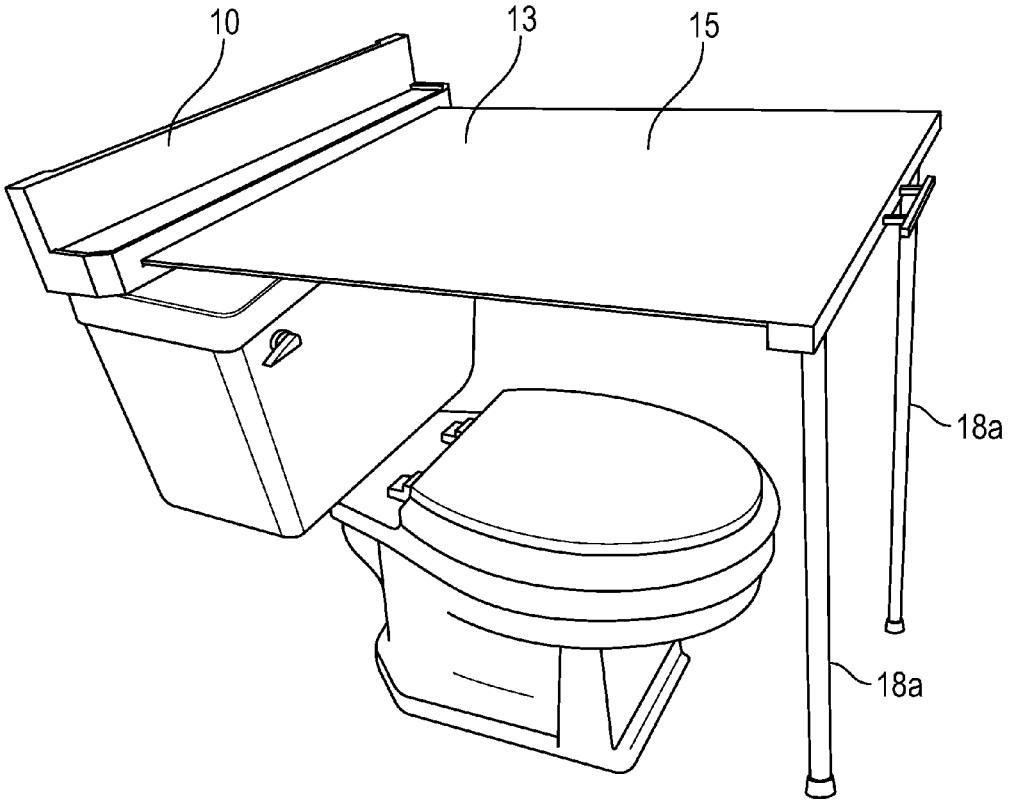
FIG. 8 is a perspective view showing the apparatus for organizing the restroom with alternate supporting members.

In an alternate embodiment, support members 18*a* may be of fixed length, as shown in FIG. 8. To provide a level tabletop 15 when fixed length support members 18*a* are used, the base portion 10 should be mounted at a predetermined height from a floor of the restroom. The predetermined mounting height of the base portion 10 is based on the length of the support members 18*a*. For example, when longer support members 18*a* are used, the base portion 10 should be mounted higher. When shorter support members 18*a* are used, the base portion 10 should be mounted lower. To provide an apparatus that can be mounted above the toilet with a level tabletop 15, the support members 18*a* should be longer than a height of the toilet.

The relative directions discussed herein are understood as describing the apparatus when it is in use in the restroom as described herein and shown in the figures.

It is to be understood that the disclosure is not to be limited to the disclosed embodiments but, on the contrary, is intended to cover various modifications and equivalent arrangements included within the spirit and scope of the appended claims.

What is claimed is:

1. A retractable table apparatus comprising:

a table portion, the table portion including a flat planar member with a first end and a second end that defines a tabletop;

at least one support member secured to the tabletop proximate the second end of the flat planar member; and a base portion having a lateral body with an outwardly oriented surface and a lateral slot defined in the outwardly oriented surface and projecting into the lateral body, the slot dimensioned to receive the first end of the tabletop;

wherein the second end of the tabletop is insertable in the slot to place the apparatus in a first condition where a user has access to the tabletop, and wherein when the second end of the tabletop is removed from the slot, the apparatus is placed in a second storage condition.

2. The apparatus of claim 1 wherein the base portion is removably mountable to a vertical support surface such that the lateral slot is oriented horizontal to the plane of use.

3. The apparatus of claim 2 wherein the base portion is mounted to the vertical support surface at a location overlying a toilet and wherein the tabletop is dimensioned to extend over the toilet when the table portion is oriented in a use position.

4. The apparatus of claim 1 wherein the at least one support member is configured as a leg and is moveable between an extended use position and a retracted storage position.

5. The apparatus of claim 1 wherein the base portion further comprises at least one vertical slot extending from a first upper surface of the base portion to a second lower opposed surface of the base portion, the vertical slot oriented perpendicular to the lateral slot, the vertical slot configured to removable receive at least a portion of the tabletop therein.

6. The apparatus of claim 5 wherein the at least one support member is moveable between an extended use position and a retracted storage position and when retracted can be are oriented above the vertical slot when the tabletop is removably received therein.

7. The apparatus of claim 1 further comprising an enclosure connected to the first end of the tabletop, wherein the at least one support member is moveable between an extended use position and a retracted storage position and when retracted can be oriented above the vertical slot when the tabletop is removably received therein, wherein the base portion is removably mountable to a vertical support surface such that the lateral slot is oriented horizontal to the plane of use, the base member further comprising at least one vertical slot extending from a first upper surface of the base portion to a second lower opposed surface of the base portion, the vertical slot oriented perpendicular to the lateral slot, the vertical slot configured to removable receive at least a portion of the tabletop therein.

8. A retractable table apparatus for use in a restroom with a toilet, the retractable apparatus comprising:

a base portion with a slot formed in a front surface of the base portion, the base portion including a back surface having a pair of extruded portions positioned on either side of a recessed portion, and the base portion having the form of an L-shape extending in a width direction at least as far as a width of the toilet.

* * * * *